United States Patent [19]

Knabe et al.

[11] 4,298,039

[45] Nov. 3, 1981

[54] REVOLVING CONTAINER PROCESSING PLANT

[75] Inventors: Uwe Knabe, Dortmund; Siegmar Sindermann, Kamen-Heeren; Heinrich Jordan, Dortmund, all of Fed. Rep. of Germany

[73] Assignee: Holstein and Kappert GmbH, Dortmund, Fed. Rep. of Germany

[21] Appl. No.: 82,625

[22] Filed: Oct. 9, 1979

[30] Foreign Application Priority Data

Oct. 20, 1978 [DE] Fed. Rep. of Germany ..... 2845646

[51] Int. Cl.[3] ..... B65B 3/04; B67C 7/00; B08B 3/02

[52] U.S. Cl. ..... 141/90; 141/91; 141/371; 134/81; 134/183

[58] Field of Search ..... 134/78–81, 134/152, 170, 183, 199; 137/238; 141/51, 89, 90, 91, 165, 172, 177, 282, 312, 367, 369, 370, 371, 372, 374, 392, 140; 212/148

[56] References Cited

U.S. PATENT DOCUMENTS 4,207,932 6/1980 Gilmour ..... 141/90

*Primary Examiner*—Houston S. Bell, Jr.
*Attorney, Agent, or Firm*—Toren, McGeady & Stanger

[57] ABSTRACT

A liquid filling valve arranged on a rotating tank of liquid for filling bottles includes a spray line for directing a cleansing spray of the liquid against liquid carrying parts in the event of bottle breakage. A valve is provided in the body of the filling valve for communicating the liquid from a liquid feeder line to the spray line, the internal valve being arranged to be actuated upon breakage of a bottle.

13 Claims, 5 Drawing Figures

REVOLVING CONTAINER PROCESSING PLANT

BACKGROUND OF THE INVENTION

The present invention relates to revolving container processing plants, and more particularly to a container processing plant having filling valves arranged on a rotating tank of liquid, each of the valves having an associated base for a container to be filled.

Container processing plants of the type wherein filling valves are arranged to extend from a rotating tank of liquid, to fill glass bottles associated with the valves, have presented serious problems in the past when bottle breakage occurs. For example, if a bottle breaks during filling, glass splinters and dust can coat the filling valve in operation, and adjacent valves as well. Then, during subsequent filling of another bottle by the valve, glass deposits coated thereon may mix with the liquid contents so that considerable health risks are produced. To avoid such risks, a stationary type of spray nozzle, and a spray nozzle which revolves together with the filling valve, have been provided, the outlets of such nozzles being directed at the filling valve. Such designs, however, have not proven entirely satisfactory, especially when the filling valve is coated with fine powdered glass. Further, spray jets from these nozzles contact individual valves or packing parts only from below. They cannot reach liquid carrying parts above the liquid exit nozzle, or the cross-sectional area of any connector packings provided for supporting the bottles. Accordingly, the prior spray arrangements are suitable only within limits, and the problem of eliminating the glass fragments has not been fully solved.

The object of the present invention, therefore, is to improve the prior spray nozzle arrangements so that, in case of bottle breakage, liquid carrying parts are sprayed in the direction of fluid flow.

SUMMARY OF THE INVENTION

The above and other problems in the prior art are solved in accordance with the present invention by providing a revolving container processing plant having filling valves arranged on a rotating tank of liquid, a spray liquid feeder line and a spray line directed at least against liquid carrying parts associated with each valve, and a valve coupled between the feeder and spray lines, the valve being arranged to be actuated in response to bottle breakage.

In applying the present invention to a container processing plant having a vacuum channel arranged on a tank of liquid, from which channel a connector line leads out to a liquid exit socket, it is proposed that the vacuum channel be employed as a liquid accumulator, and that spray liquid be continuously or pulse-like added by switching of a valve arranged inside the connector line.

In accordance with the present invention, a spray effect is obtained which is a substantial improvement over that of the prior art spray devices. The liquid spray obtained is effective in the direction of the filling liquid and, thus, removes glass particles from the top down and out of the danger zone. This advantage is not provided with prior art spray devices, their spray effect being mostly in a vertical or slanted direction from below toward the liquid exit socket. In that way, glass fragments deposited in certain regions are pushed upwards, where they frequently are held by packing and liquid carrying parts, to be released only when the next bottle is placed underneath. Liquid from the filling valve then causes the fragments to flow therewith into the bottle. This drawback with the prior art systems is eliminated in accordance with the present invention.

For a better understanding of the present invention, reference is made to the following description and accompanying drawing, while the scope of the present invention will be pointed out in the appended claims.

DESCRIPTION OF THE PREFERRED EMBODIMENTS

Figure 1:
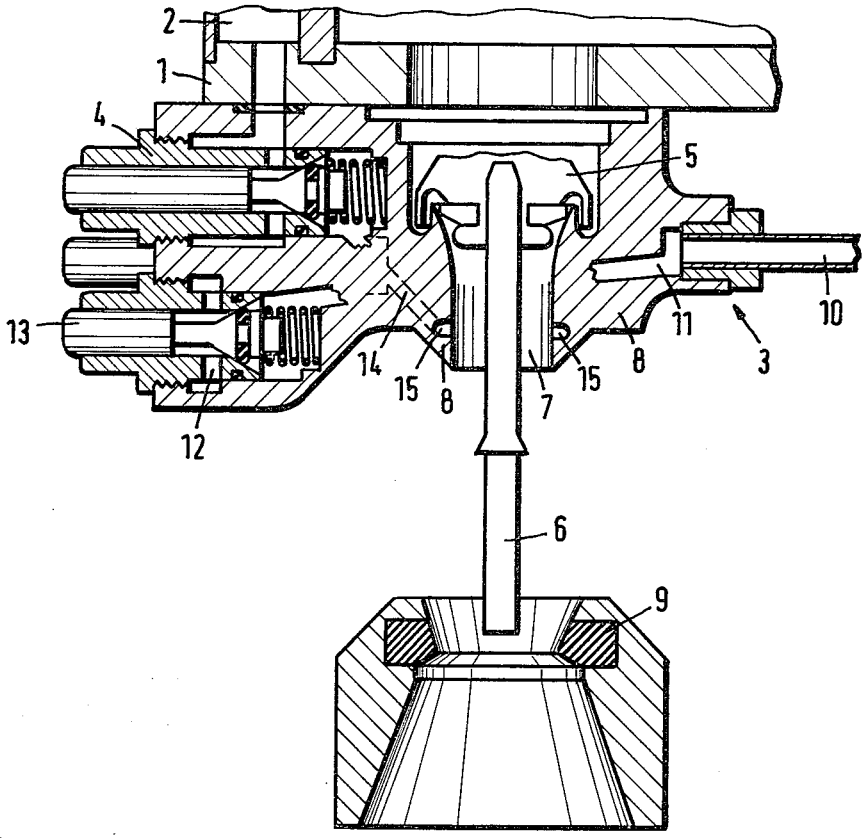
FIGS. 1–3 are sectional views of three embodiments of a revolving container processing plant in accordance with the present invention showing different arrangements of spray lines with a filling valve.
Figure 5:
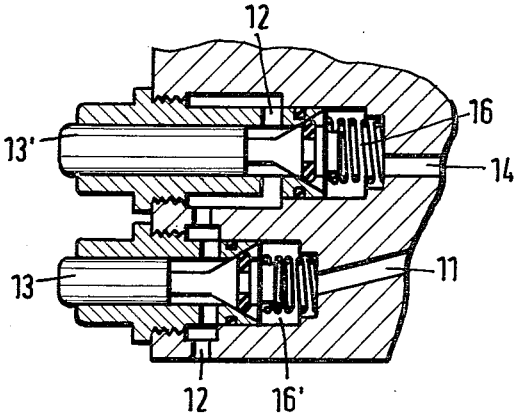
FIG. 5 is a sectional detail view of the valve block of FIG. 4.

FIG. 1 shows a container filling valve including a rotating tank of liquid 1 having a vacuum channel 2. Several filling valves 3 are associated with the tank 1, only one of which is shown in FIG. 1. Filling valve 3 has a vacuum valve 4 and other valves for unloading the tank contents. Within the valve 3, a valve closing body is located which is equipped with an air pipe 6 for feeding in a primary gas and for removing the gas admitted to the hollow space in a bottle during liquid filling.

Beneath the valve closing body 5, is located a liquid outlet socket 7. A packing seat 8 and centering elements 9, shown in FIGS. 1 and 2, are arranged against the outlet socket 7 to provide atmospheric sealing of a bottle to be lifted from below against the filling valve 3.

According to the embodiment of FIG. 1, the body of filling valve 3 is connected to a liquid feeder line 10. A passageway 11 within the valve body communicates with a valve 12 arranged within the valve body, valve 12 being arranged on the same level with vacuum valve 4. Valve 12 has an initial valve space which opens upon actuation of a valve tappet 13 to establish fluid communication with spray liquid lines 14. Liquid lines 14 can be in the form of a ring conduit having a plurality of exit nozzles 15.

Valve tappet 13 projects radially outward from the circular path described by the movement of filling valve 3, and can be actuated by running up against a control path or surface (not shown) which is actuated upon bottle breakage. Valve tappet 13 can also be acutated by pneumatic, electrical or hydraulic control pulses. Also, actuation by proximity actuators in connection with solenoid valves is feasible.

Figure 2:
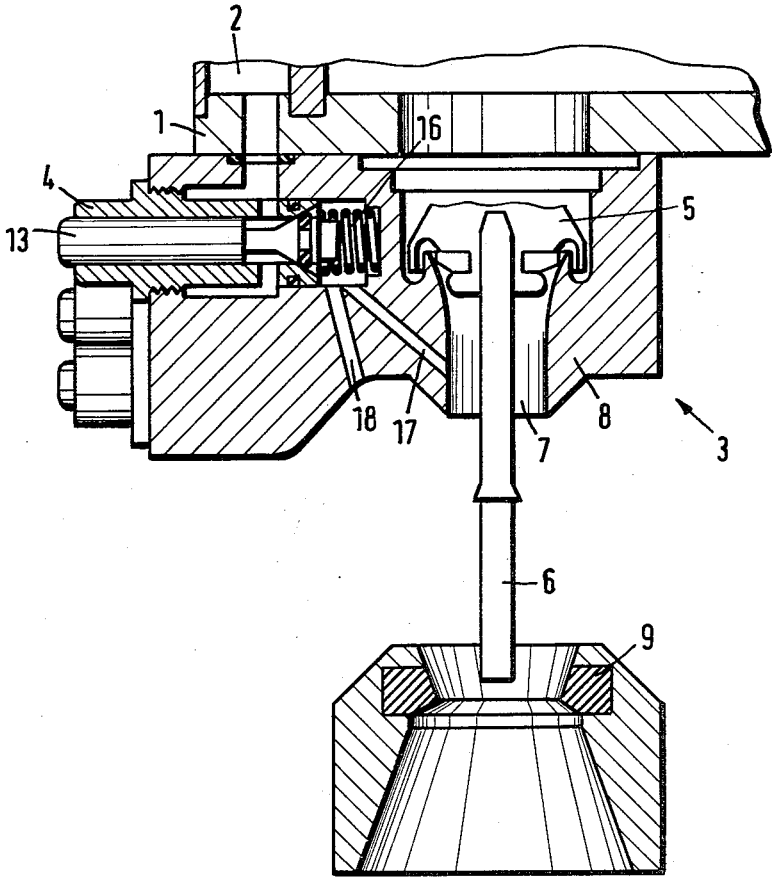

FIG. 2 shows another embodiment of the present invention wherein the vacuum channel 2 of the liquid tank 1 is employed as a spray liquid accumulator. Spray liquid is fed through vacuum channel 4 to communicate with annular space 16 from which one or more spray lines 17, 18 branch off. According to this embodiment, spray line 17 leads into outlet socket 7. The other spray line 18 from the annular space 16 is directed against upwardly projecting portions of the packing and centering elements 9. Additional, unshown spray lines can be arranged to direct a liquid spray over the entire filling valve.

Figure 3:
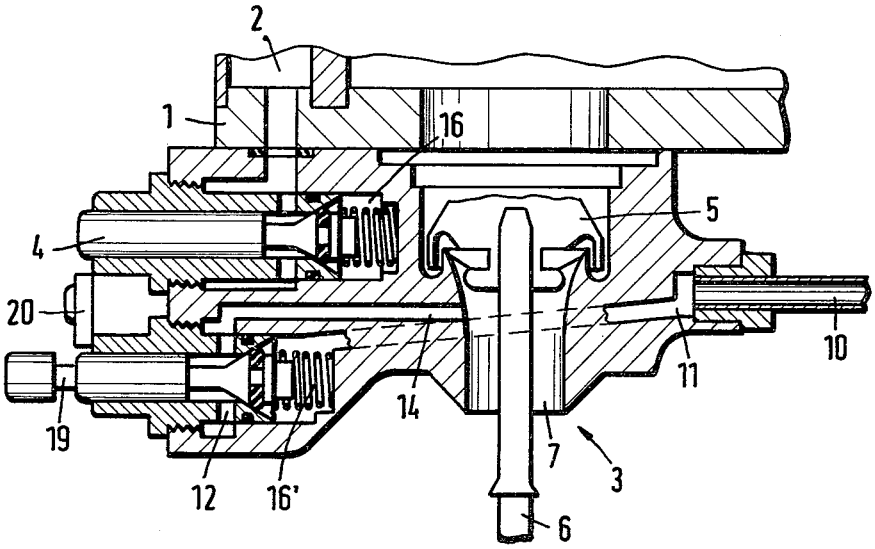
Figure 4:
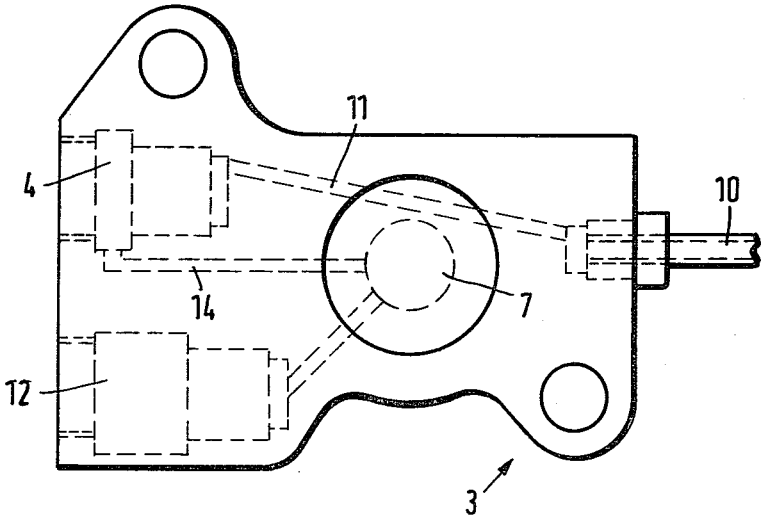
FIG. 4 is a top view of a valve block used in the plants of FIGS. 1–3.

FIG. 3 shows spray liquid lines communicating between a space 16' to space 16, thereby communicating with vacuum channel line 2.

In addition to the provision of a liquid spray by using a pulse emitter to pivot a valve control surface, a liquid accumulator element can be used to enable a second cleansing of a given filling valve upon a second revolution of the valve.

Moreover, the valve tappet 13 of a filling valve design, such as shown in FIG. 1, can be modified by providing a reduced diameter portion 19 thereon for engaging a pivotal lever 20 as shown in FIG. 3. By this arrangement, the internal valve 12 is maintained in an opened condition until the pivotal lever 20 is unlatched from the tappet 13 to an initial position, e.g., at the end of one revolution of the filling valve 3.

While the foregoing description and drawing represent the preferred embodiments of the present invention, it will be obvious to those skilled in the art that various changes and modification may be made therein without departing from the true spirit and scope of the present invention.

What is claimed is:

1. A revolving container processing plant comprising a tank for holding liquid to be filled into containers, said tank being mounted for rotational movement, a plurality of filling valves arranged on said tank for filling containers with said liquid and at least one liquid feeder passageway for communicating said liquid from said tank to said filling valves, each of said filling valves including a valve body having a liquid outlet opening for passing said liquid into the containers and at least one spray passageway in said valve body for directing a liquid spray from inside said valve body into said liquid outlet opening so that the liquid spray contacts at least liquid carrying parts of said filling valve to remove container fragments therefrom, and an interconnecting valve coupled between said feeder passageway and said spray passageway for transmitting liquid in said feeder passageway to said spray passageway in response to breakage of a container.

2. A revolving container processing plant comprising a tank for holding liquid to be filled into containers, said tank being mounted for rotational movement and having a vacuum channel communicating therewith, a plurality of filling valves arranged on said tank for filling containers with said liquid and at least one liquid feeder passageway for communicating said liquid from said tank to said filling valves, each of said filling valves including a valve body having a liquid outlet opening for passing said liquid into the containers and at least one spray passageway in said valve body for directing a liquid spray from inside said valve body into said liquid outlet opening so that the liquid spray contacts at least liquid carrying parts of said filling valve to remove container fragments therefrom, and an interconnecting valve coupled between said vacuum channel and said spray passageway for transmitting liquid in said channel to said spray passageway in response to breakage of a container wherein said vacuum channel operates to accumulate liquid to be supplied to said spray passageway.

3. A container processing plant according to claims 1 or 2, wherein said interconnecting valve is constructed and arranged to be actuated in a pulse-like manner in response to the breakage of a container.

4. A container processing plant according to claims 1 or 2, wherein said interconnecting valve projects in a radially outward direction relative to the path of movement of said filling valve to engage a control surface which moves pivotally relative to said interconnecting valve in response to the breakage of a container.

5. A container processing plant according to claims 1 or 2, wherein said interconnecting valve is contstructed and arranged to be actuable in response to hydraulic control pulses.

6. A container processing plant according to claims 1 or 2, wherein said interconnecting valve is constructed and arranged to be actuable in response to pneumatic control pulses.

7. A container processing plant according to claims 1 or 2, wherein said interconnecting valve is constructed and arranged to be actuable in response to electrical control pulses.

8. A container processing plant according to claims 1 or 2, wherein said interconnecting valve is arranged to be actuated during a plurality of revolutions of said filling valve.

9. A container processing plant according to claims 1 or 2, wherein said interconnecting valve includes a valve seat arranged on the side thereof which is coupled to said spray passageway, and each of said filling valves includes a spray liquid chamber in communication with said valve seat and said spray passageway, said spray passageway being arranged to direct liquid spray against packing parts located beneath said filling valve to remove container fragments therefrom.

10. A container processing plant according to claims 1 or 2, wherein each of said filling valves has a liquid outlet socket forming said liquid outlet opening, and said spray passageway is in annular form and has a plurality of spray nozzles communicating therewith, said nozzles being arranged on the interior of said socket.

11. A container processing plant according to claims 1 or 2, wherein each of said filling valves has a liquid outlet socket forming said liquid outlet opening, and said spray passageway is in annular form and has a plurality of spray nozzles arranged on the exterior of said socket.

12. A container processing plant according to claims 1 or 2, wherein said interconnecting valve includes an elongated tappet for controlling actuation thereof, said tappet being supported for movement along its longitudinal axis and being arranged to be maintained in a first position during a first revolution of said filling valve wherein said interconnecting valve is actuated, and in a second position after said filling valve completes said first revolution wherein said interconnecting valve is deactuated.

13. A container processing plant according to claims 1 or 2, further including a plurality of spray nozzles arranged on said filling valve and communicating with said spray passageway for directing a liquid spray against said filling valve and against packing parts located beneath said filling valve to remove container fragments therefrom.

* * * * *